United States Patent [19]

Woodruff

[11] 4,365,768

[45] Dec. 28, 1982

[54] CABLE REEL ADAPTER

[76] Inventor: Harold F. Woodruff, 2340 Avocado Ter., Hacienda Heights, Calif. 91745

[21] Appl. No.: 242,726

[22] Filed: Mar. 12, 1981

[51] Int. Cl.[3] ..... B65H 75/40; B65H 57/38

[52] U.S. Cl. ..... 242/86.7; 242/68.4; 242/156.2; 414/607; 414/911

[58] Field of Search ..... 242/86.7, 86.5 R, 99, 242/54 R, 68.4, 156, 156.2; 414/607, 911

[56] References Cited

U.S. PATENT DOCUMENTS

| | | | |
|---|---|---|---|
| 1,693,876 | 12/1928 | Unruh | 242/68.4 |
| 1,825,218 | 9/1931 | Van Hook | 242/54 R |
| 1,874,904 | 8/1932 | Crafts | 242/58.6 |
| 2,215,651 | 9/1940 | Pierce | 242/86.5 R |
| 2,655,771 | 9/1953 | Marion | 242/54 |
| 2,714,463 | 8/1955 | Fraser | 214/620 |
| 2,891,764 | 6/1959 | Pearne | 254/1 |
| 2,913,854 | 10/1960 | McClure | 242/75.4 |
| 3,258,219 | 6/1966 | McLendon | 242/86.7 |
| 3,264,026 | 8/1966 | Hansen | 414/607 X |
| 3,586,256 | 6/1971 | Wellman | 242/86.7 |
| 3,690,492 | 9/1972 | Shore | 214/620 |
| 3,930,585 | 1/1976 | Lynch | 214/620 |
| 3,944,094 | 3/1976 | Compton | 214/390 |
| 3,995,758 | 12/1976 | Kovaleski | 214/330 |
| 4,025,006 | 5/1977 | Turnbow | 242/86.5 R |
| 4,030,704 | 6/1977 | Beierle | 254/139.1 |
| 4,085,904 | 4/1978 | McElroy | 242/54 R |
| 4,098,468 | 7/1978 | Skolleberg | 242/54 |
| 4,127,241 | 11/1978 | Conti | 242/156.2 |

*Primary Examiner*—Edward J. McCarthy
*Attorney, Agent, or Firm*—Lyon & Lyon

[57] ABSTRACT

An apparatus useful for lifting a reel having cable wound thereabout for dispensing the cable includes oppositely positioned bearing housings operative to support spindle assemblies which are receivable into the reel to occasion rotation of the reel about its mandrel apertures or central axis. At least one of the bearing housings has a disk brake assembly operative therewith and associated controlling mechanisms for resisting rotation of one of the spindle assemblies. A braker arm attached to the spindle assembly operative with the disk brake assembly imparts a torque opposing the rotation of the reel for braking the reel. The apparatus is adapted to receive the forks of a forklift truck and be suspended thereby.

7 Claims, 2 Drawing Figures

CABLE REEL ADAPTER

BACKGROUND

This invention relates to an apparatus for dispensing cables from reels wherein the reels can be lifted from the ground by a conventional forklift truck.

Many elongated elements, such as cable, rope, or metal sheet stock are wound about an axle or core section having oppositely positioned sides or flanges to form a reel for storage or dispensing purposes. After these reels have been formed and are loaded with cable, they are stored in warehouses or storage facilities until the cable is needed. Because these cable reels can weigh over 10,000 lbs., it is desirable to make them of materials capable of withstanding heavy loads. Customarily, this is accomplished by having a metal core section about which the cable is wound and two oppositely positioned side flanges made of either steel spokes and rims integral therewith, or oppositely crossed wood planks. These side flanges can be provided with a plurality of cross braces to accommodate increased strength and resistance to buckling or lateral deformation of the side flanges.

It is often required that these reels be moved about the warehouse facilities or storage locations to accomodate the storage of additional reels. It is similarly required that they be moved about the aforementioned facilities to expedite loading the reel onto dispensing structures, which are then operative to permit unwinding of the cable during cable laying operations. In the past this has required the use of a lift truck or other suitable structure for moving the reel about the warehouse facility.

An even greater problem is incurred in removing the cable from the reels. It is often required that the material wound about these cable reels be loaded onto other reels, which are operative with trucks or machines useful for dispensing the cable for desired purposes. Prior art apparatuses for suspending these reels for dispensing cable included inverted U-shaped stands with spindles disposed at their uppermost section for receiving the reel to facilitate unwinding of the cable. These strands were immovable and thus inflexible with regard to their positioning about the warehouse facility.

Therefore, it is desirable to provide an apparatus which permits the movement of these reels about the storage facilities and simultaneously provides the ability to dispense the material contained thereon once the reel is located at the desired position.

Particularly in the case of very heavy reels, considerable danger existed due the rotational inertia gained by the reel during unwinding operation. Therefore, in many cases two or three men would be required to selectively control the reel rotation during dispensing operations using stands of the nature found in the prior art. Because of the extreme danger associated with unwinding materials at high speeds, it is necessary to provide a reel speed controlling means to adjust reel pay-out with material requirements.

In U.S. Pat. Nos. 2,714,463 to Fraser, and 3,930,585 to Lynch apparatuses are disclosed for moving a cable reel about a warehouse facility.

In U.S. Pat. Nos. 3,913,854 to McClure, 4,025,006 to Turnbow, 1,693,876 to Unruh, 1,825,218 to Hook and 2,650,771 to Marion, apparatuses are disclosed for permitting the unwinding of cable.

These prior stands were unacceptable in that they did not illustrate the ability to simultaneously permit lifting, movement, and controlled dispensing of cable from heavy reels. The unacceptability of these prior art apparatuses has been generally acknowleged. They uniformly required additional personnel to operate them in a manner which facilitated the controlled dispensing of cables.

Therefore, there is a need for an apparatus which supports a cable reel off the ground for dispensing cable found thereon.

There is a further need for an apparatus which simultaneously provides for the movement of a cable reel around a facility, wherein when the cable reel is located at the desired location it is possible to control dispensing of the cable wound thereabout with only one operator.

SUMMARY

The present invention is directed to a reel supporting apparatus that meets these needs. The invention of the present application in its operation seeks to obviate the problems associated with these prior art devices and eliminate the need for more complex equipment and additional manpower.

An apparatus is disclosed which has oppositely positioned bearing housings supporting spindle assemblies which are receivable into the core section or mandrel apertures of the reel having cable or other material wound thereabout. The bearing housings have means operative therewith for mounting them and securing them substantially immovably onto the forks of a conventional forklift truck.

Preferably, the apparatus disclosed herein has means for maintaining the bearing housings off the ground in the inoperative state, thus facilitating easy loading of the apparatus onto the forks of a conventional forklift truck. The bearing housings are further provided with a plurality of bearings contained therein for facilitating easy rotation of the spindle assemblies supporting the reel disposed therebetween. The bearing housings are adapted to engage and support reels of various widths.

At least one of the bearing housings has a disk brake assembly operative therewith, whereby it is possible to control the rotation of the spindle assembly being supported by that bearing housing. An axle integral with the spindle assembly is disposed through the bearing housing and is connected to a disk which is disposed between the opposing shoes of a disk brake assembly. Upon selective imposition of a force upon the shoes, a braking action is effected upon the disk, thereby slowing down rotation of the axle and spindle assembly.

The same spindle assembly, which has operative therewith the disk brake assembly, has a braker arm located on the opposite side of the bearing housing from the disk brake assembly. The braker arm has a means associated therewith for engaging a side flange of the reel, whereby, upon attenuated rotation of the spindle assembly, the braker arm will impart a torque opposite the direction of reel rotation upon the flange. In this manner the apparatus of the present invention can control reel rotation.

It is thus possible to engage a reel, provide for its support off the ground to facilitate cable dispensing operations, and simultaneously control reel rotation to protect against the creation of substantial inertial forces due to reel rotation.

It is important to note that the ability to control reel rotation is independent of the height which the reel is supported off the ground. Similarly, the ability to control reel rotation and support the reel off the ground is, with certain limitations, independent of the height and width of the reel.

These and other features and advantages of the present invention will become more fully understood from the following description and appended claims when read in connection with the accompanying drawings.

BRIEF DESCRIPTION OF THE PREFERRED EMBODIMENT

According to the present invention, there is provided a cable reel supporting apparatus and forklift adapter for use in dispensing cable or other materials under controlled conditions.

With reference to the accompanying drawings, wherein similar structures are identified with similar numerals in the various figures, the improved cable reel support apparatus of the present invention is shown and generally designated by the numeral 10.

Figure 2:
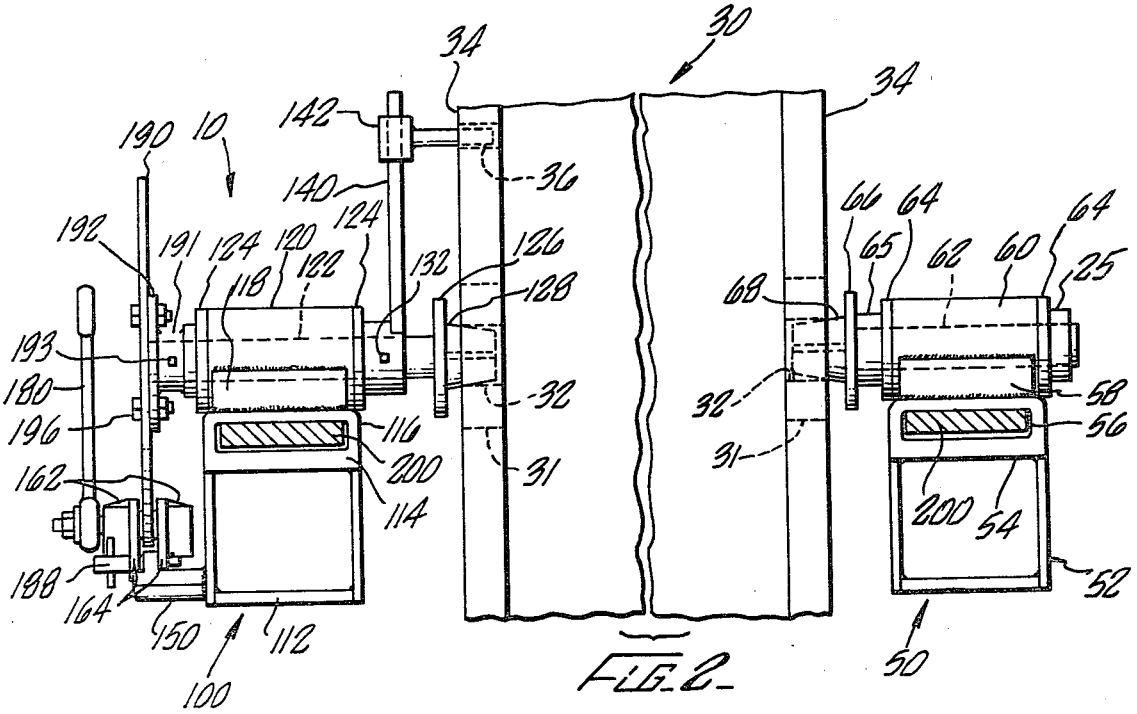
FIG. 2 is a front view of an assembled apparatus in accordance with the present invention, mounted upon the forks of a conventional forklift truck, illustrating the position of the spindle assemblies and disk brake assembly with regard to the cable reel.

As best seen in FIG. 2, oppositely positioned reel support units 50, 100 are adjustaply mounted upon the forks of a conventional forklift truck (not shown) and are adapted to support a reel 30 having material wound thereabout. The reel support units 50, 100 are useful to provide controlled rotation of the reel 30 during dispensing operations.

A conventional reel 30 is provided to support the wound material and facilitate its discharge and dispensing. The reel 30 has a core section 31 which is substantially cylindrical in form and at its opposite ends defines mandrel apertures 32 which may connect to form a channel or may simply extend a predetermined distance into the core section 31. The mandrel apertures 32 are adapted to receive the spindle assemblies associated with the reel support units 50, 100 for supporting the reel 30 off the ground. The apertures 32 are substantially coaxial and thus assure that the axis of rotation of the reel 30 is substantially parallel to the ground, thereby eliminating the possibility of off-balance rotation and the potential hazards associated therewith.

Figure 1:
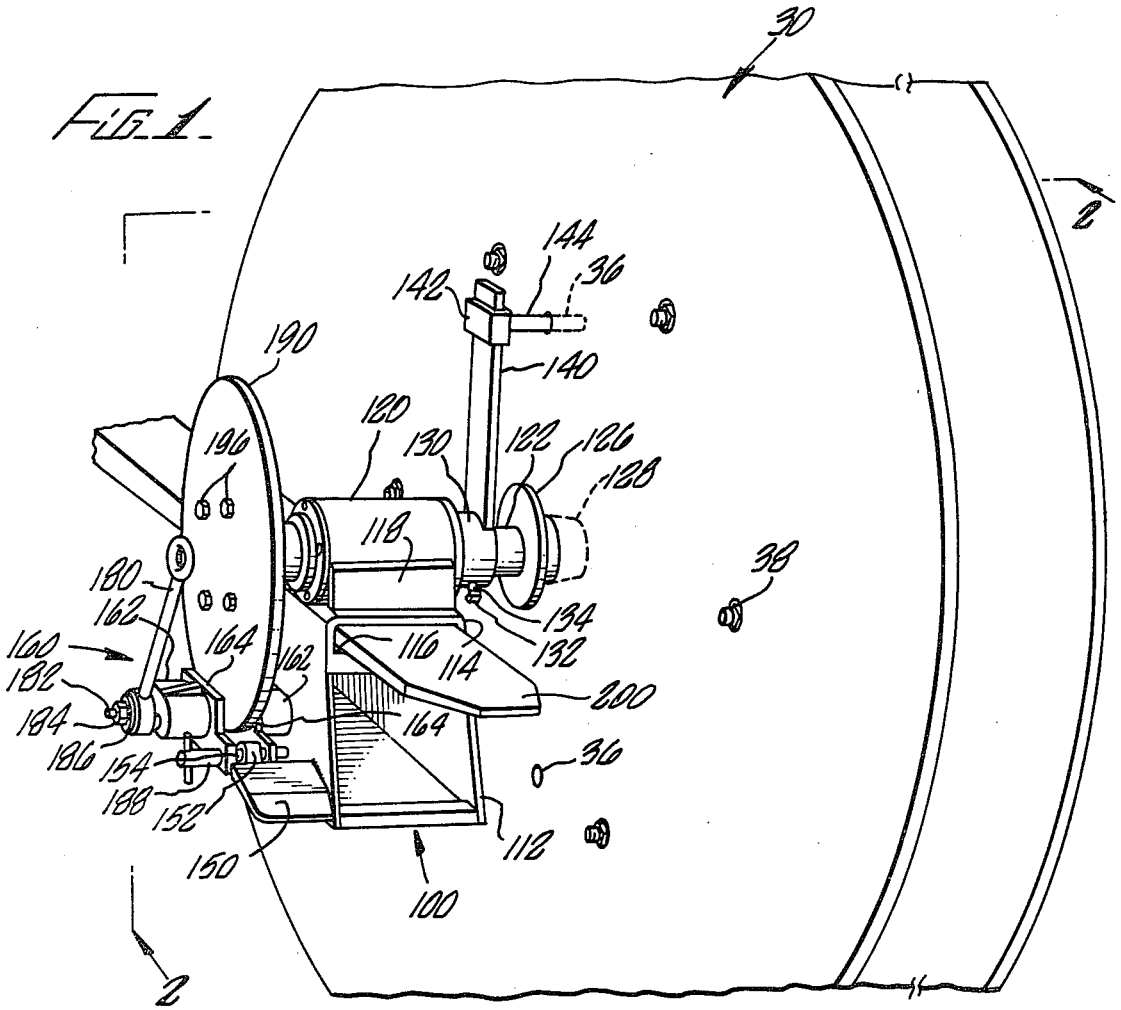
FIG. 1 is a side view showing one of the bearing housings of the apparatus of the present invention fitted upon one of the forks of a conventional forklift truck, the bearing housing having a disk brake assembly cooperatively engaged therewith.

The reel 30 further has oppositely positioned end flanges 34, at least one of said end flanges 34 having a plurality of radial apertures 36 removed a discreet distance from the mandrel aperture 32 and defined within the side flange 34. The position of these apertures 36 is best shown in FIG. 1. These apertures 36 can be positioned at various locations on the side flanges 34 without departing from the ability to use the apparatus of the present invention.

There can also be provided a plurality of bolts 38 which are operative to juxtapose the several layers forming the side flanges 34. The side flanges 34 can be provided a plurality of support braces (not shown) for increasing the resistance of the reel 30 to lateral deformation or damage. The support braces (not shown) extend along the external surfaces of the side flanges 34 and are customarily radially disposed. The present cable reel adapter 10 is utilizable with reels 30 having support braces (not shown) integral therewith.

The reel support 50 has a base member 52 which is elongated and substantially square in cross-section and preferably is hollow. The base member 52 is adapted to suspend the remaining portions of the reel support unit 50 off the ground. This base member 52 can be made of materials such as wood, metal or hard plastics. Integral with and disposed above the base member 52 is support member 54 which has a substantially rectangular slot 56 defined in the center portion thereof. The slot 56 passes entirely through the support member 54 and is adapted to receive one of the forks 200 (shown in cross-section in FIG. 2) of the size provided with conventional forklift trucks. The forks 200 may be variable in size and profile, therefore requiring that the slot 56 be of a configuration adapted to receive a wide variety of fork profiles.

Oppositely positioned flanges 58 extend upwardly from the support member 54 and can be slightly outwardly angled with respect to each other. These flanges 58 are spaced apart along the support member 54 to provide a channel for receiving a bearing housing 60. In the preferred embodiment the bearing housing 60 is substantially cylindrical in form and is secured between the flanges 58 by welding or other appropriate means. An axle 62 extends through the bearing housing 60, and is retained therein by dual sealing members 64 which have locking means associated therewith for retaining the axle within the bearing housing 60. Within the bearing housing 60 are a plurality of bearings (not shown) of the conventional type. These bearings are adapted to receive and support the axle 62 and provide for its rotation during the course of cable dispensing operations.

Disposed about the portion of the axle 64 which extends toward the reel 30 is a sleeve 65 which entirely encompasses the axle 62. Extending outwardly from the sleeve 65 and attached thereto is a ring 66 which is integral with and supports an outwardly extending first spindle 68. The spindle 68 is sized to fit within the mandrel aperture 32 of the conventional reel 30 as is used in the storage or dispensing of coiled cable or material. The spindle 68 in the preferred embodiment is frustoconical in form, which permits it to be secured substantially immovably with respect to the reel 30 irrespective of the diameter of the mandrel aperture 32. The spindle 68 can be provided with a plurality of tangentially spaced apart splines for facilitating the substantially immovable juxtaposition of the spindle 68 with respect to the reel 30 for cable or material dispensing operations.

The axle 62 can be mounted in the bearing housings so that it is longitudinally adjustable with respect to the bearing housing 60 to facilitate the cooperative engagement with reels 30 of various widths. It should also be noted that the ring 66 is provided to index the maximum amount that the spindle 68 may enter the mandrel aperture 32.

With reference to FIG. 1, a second reel support unit 100 has a substantially square base member 112 which is adapted to suspend the remaining portions of the second reel support unit 100 off of the ground. As in the case of the reel support unit 50, integrally attached to the base member 112 is a support member 114 which also has a rectangular slot 116 defined substantially in the center thereof and extending entirely through the support member 114. The slot 116 is adapted to receive a fork associated with a conventional forklift truck and has a configuration similar to that of the slot 56.

With reference to FIGS. 1 and 2, upwardly extending from the support member 116 are dual flanges 118 which are outwardly angled with respect to each other and which are spaced apart along the support member 116 in a manner to receive and maintain the reel rotation and support structures as identified hereinafter. Welding may be utilized with the flanges 118 to secure the remaining support structures. A second bearing housing 120 is fitted between the upwardly extending flanges 118 and is operative to provide for the regulated rotation of the reel 30. An axle 122 extends through the bearing housing 120, which has sealing members 124 disposed at its opposite sides. The housing 120 is operative to receive and support the rotatable elements of the bearing housing 120.

The axle 122 is disposed partially within the bearing housing 120. Along the portion of the axle 122 which faces the reel 30 there is defined a ring 126 integral with the axle 122. A second spindle 128 is secured to the ring 126 and axle 122 and is receivable into the other mandrel hole 32 of the reel 30. The second spindle 128 is substantially frustoconical in shape and may have a plurality of radially spaced-apart parallel splines disposed along its periphery and adapted to maintain the spindle 128 in a substantially immovable manner with respect to the reel 30. As in the case of the first reel support unit 50, the bearing housing 120 also has bearings (not shown) contained therein which are adapted to support and provide for the rotation of the axle 122 and reel 30 during dispensing operations.

The rings 66, 126 provided with the spindle assemblies 50, 100 are operative to define the maximum depth that the spindles 68, 128 may assume within the mandrel apertures 32. Grease fittings (not shown) can be provided with each of the bearing housings 50, 100 to facilitate the application of lubricant to the bearings (not shown) contained therein.

A sleeve 130 is fitted entirely about the axle 122, as it extends through the side of the bearing housing 100, and has a locking member 132 disposed within a threaded aperture 134 defined in the sleeve 130. The member 132 is operative to immovably position or lock the sleeve 130 with respect to the axle 122. In the preferred embodiment this locking member 132 comprises a threaded bolt receivable into an oppositely threaded aperture, wherein the bolt 132 may be tightened within the sleeve 130 to cause the sleeve 132 to move with the rotation of the axle 122.

A flange 140 extends upwardly from the sleeve 130 and is substantially parallel to the plane of the side flange 34. A slidably engaged bracket 142 is disposed about the periphery of the flange 140. Outwardly extending toward the reel 30 from the bracket 142 in a plane substantially parallel to the axle 122 is a rod 144 which is receivable into one of the apertures 36 defined within the side flanges 34 of the reel 30. The rod 144 is operative to enter into the aperture 36 thus maintaining the flange 140 in an aligned engagement with the reel 30. The rod 144 can be provided with splines along its periphery to secure it immovably within the aperture 36. The slidable engagement of the bracket 142 with respect to the flange 140 permits the placement of the rod 144 within the apertures 36 defined in the side flanges 34 irrespective of the position of apertures 36 along the surface of the side flange 34. A locking bolt (not shown) can also be provided with the bracket 142 to rigidly affix it to the flange 140.

Welded to the base 112 is a curved lip 150 which extends outwardly from the base 112 and has a mount section 152 with an aperture 154 defined substantially in the center thereof. Although not illustrated in FIGS. 1 or 2, a second mounting structure (not shown) is welded along the other side of the base 112 and is provided with a locking means for securing the other end of the disk brake assembly as will be described hereinafter. The lip 150 and other mounting structures (not shown) are adapted to receive and support the elements of a standard disk brake assembly, the operation of which is known in the art.

A disk brake assembly 160 has oppositely positioned pucks 162, biased away from each other, with brake linings 164 secured thereto. The pucks 162 are adapted to move toward each other under the application of a force.

A control arm 180 is operatively connected to the pucks 162 whereby rotation of the control arm 180 occasions movement of the pucks 162 toward each other. The control arm 180 is supported upon a bolt 182 which extends into the center of the pucks 162 and is supported thereby. A locking nut 184 is adapted to retain the control arm 180 in a rotatable relation with respect to the pucks 162. Washers 186 are provided to facilitate rotation of the control arm 180 independent of its position upon the locking nut 184.

A locking pin 188 extends through the oppositely positioned brake linings 164 and is receivable into the aperture 154 defined within a mount 152 in a manner which positions the disk brake assembly 160 properly with respect to the base member 112. The pin 188 further permits movement of the brake linings 164 toward each other as the pucks 162 move under action of the force imparted by the control arm 180.

As best shown in FIG. 2, a disk 190 of the type provided with a disk brake assembly is attached to a sleeve 191 which extends about the axle 122 and is secured thereto by locking means 193 which in the preferred embodiment consists of a threaded bolt receivable into a threaded aperture extending into the sleeve 191 and operative to engage the axle 122 when fully located in place. The sleeve 191 has a substantially round plate 192 integral with it, which has a plurality of apertures (not shown) defined radially along its circumference. A plurality of apertures (not shown), defined within the disk 190, are adapted to be aligned with the apertures defined within the plate 192 whereby locking means 196, which in the preferred embodiment consists of bolts and nuts can be disposed therethrough, thus facilitating the combined rotation of the disk 190 with the plate 192, sleeve 191 and axle 122. In this manner rotation of the axle 122 in accordance with rotation of the reel 30 will occasion rotation of the plate 192 and associated rotation of the disk 190.

The brake linings 164 associated with the pucks 162 are operative to engage the disk 190 upon movement of the control arm 180 which, as stated previously, occasions an inward movement of the pucks 162 toward each other.

A pair of forks 200 as provided with a standard forklift truck for receivable into the slots 56, 116 of the individual reel support units 50, 100. A locking means (not shown) may be provided with each reel support unit 50, 100 to affix the reel support units 50, 100 along the length of the forks. In the preferred embodiment this locking means comprises a set screw which is receivable into an aperture having threads integral therewith, wherein the set screws, upon rotation within the apertures, can engage the forks thereby stabilizing the reel support units 50, 100 upon the forks 200.

In operation, the reel support units 50, 100 are spaced apart on the ground in front of the forklift truck. A conventional forklift truck is then driven up to the reel support units 50, 100 and under action of the operator lowers its forks 200 to the lowermost position. The forks 200 are then receivable into the rectangular slots 56, 116 defined within the support members 54, 114. The forks 200 provided with standard forklift trucks may be spaced apart variable distances depending upon the size of the reel 30 that is to be supported. As indicated previously, the forks 200 may have various pitches associated with their surfaces consequently upon engagement with the slots 56, 116, the reel support units 50, 100 are positionable somewhat up the length of the forks 200.

After the reel support units 50, 100 have been locked onto the forks 200, the forklift truck then approaches the reel 30. By raising the forks 200, as is provided with forklift trucks, the reel support units 50, 100 are positionable whereby the spindles 68, 128 are receivable into the mandrel holes 32 defined within the side flanges 34 of the reel 30. By then positioning the bracket 142 such that the rod 144 is receivable into one of the apertures 36 defined along the side flanges 34, the forks 200 of the forklift truck may then be pushed together thereby securing the spindles 68, 128 within the mandrel holes 32. As indicated previously, the spindles 68, 128 may have various forms depending upon the size of the mandrel holes 32 and desired engagement.

After this operation has been accomplished, the forks 200 may then be further raised to a higher position thereby lifting the reel 30 off the ground. Once this has been accomplished the cable dispensing or material dispensing operation from the reel 30 may be performed.

As the material contained on the reel 30 is being unwound, substantial reel inertia can develop, depending in part on the speed with which the material is being taken from the reel 30. The operator can then position himself next to the reel 30 whereby he is able to actuate the control arm 180. If the operator determines that slack or over-payout is appearing in the material as it is being removed from the reel 30, or that the rotational inertia of the reel 20 is becoming too great, the operator may then rotate the control arm 180 downwardly, thereby occasioning movement of the pucks 162 and operative engagement between the disk 190 and the linings 164.

Further application of force on the control arm 180 will cause the disk 190 to begin to rotate slower. The engagement of the disk 190 with the plate 192 and sleeve 191, which is affixed to the axle 122, will occasion a slower rotation of the axle 122. Since the axle 122 is integrally connected with the braker arm 140, a controlled rotation of the axle 122 will affect the application of a torque opposite the direction of rotation of the reel 30, the torque being applied as a result of the positioning of the rod 144 within the aperture 36. Some braking effect may also be accomplished if the spindle 128 has splines integrally associated therewith whereby friction will exist between the spindle 128 and the mandrel hole 32. In this manner the safe dispensing of cable or other materials wound about the reel 30 can be accomplished. It should be noted that other forms of disk brake on clutch assemblies can be utilized with the aforementioned reel support units 50, 100 to occasion controlled rotation of the axle 122 and associated imposition of a braking torque on the reel 30.

With the disclosed invention, a multitude of reel sizes may be effectively operated upon without requiring additional handling and equipment. Additionally, because of the various types of forklift truck that may be utilized, it is possible to dispense materials from reels 30 of various heights and widths. It is further possible to dispense cable from heights much greater than was previously known.

It is also now possible to lift, dispense, and control cable rotation with the same apparatus without requiring additional apparatus and manpower. Thus, the apparatus of the present invention substantially increases the flexibility during cable dispensing and loading operations.

While the preferred embodiment of the present invention has been described in great detail and in very specific terms, such description is for illustrative purposes only. It is to be understood that changes and modifications may be made without departing from the spirit and scope of the following claims.

What is claimed is:

1. An apparatus for supporting a reel having material wound thereabout to facilitate rotation of the reel for dispensing of the material, the apparatus comprising;

(a) two reel support assemblies, one for supporting each end of the reel, each reel support assembly comprising;
  (i) a support member,
  (ii) a bearing retaining unit integral with the support member;
  (iii) an axle rotatably supported by the bearing retaining unit in a substantially horizontal position with respect to the ground;
  (iv) a spindle mounted upon the axle and adapted to receive the reel; and (b) a braking assembly comprising;
  (i) a braking disk affixed to the axle of one of the reel support assemblies,
  (ii) a caliper assembly adapted to produce a braking force upon the braking disk to occasion controlled rotation of said axle having the disk affixed thereto;
  (iii) a braker arm connected to said axle having the disk affixed thereto, the braker arm having means operative therewith for engaging the reel, whereby the braker arm selectively imparts a torque opposite the direction of rotation of the reel to brake the reel, wherein each support member includes means for receiving the forks of a forklift truck.

2. The apparatus of claim 1, which includes means for adjusting the position of the support members along the forks of a forklift truck.

3. The apparatus of claim 1, wherein at least one of the spindles has a plurality of splines disposed about its periphery.

4. The apparatus of claim 1, wherein each reel support assembly has such a braking assembly operative therewith.

5. A reel support apparatus adapted to rotatably maintain a reel off the ground, the reel support apparatus being operative with the forks of a forklift, the apparatus comprising a first reel support having a support member with a slot defined therein, the slot adapted to receive one of the forks of the forklift, an axle-retaining member integral with the first reel support and operative to journal an axle and provide for unabated rotation of the axle, a first axle disposed through the axle-retaining member, a first spindle integral with the first axle, a second reel support having a support member with a slot defined substantially therethrough, the slot adapted to receive the other of the forks of the forklift, a second axle-retaining member integral with the second reel support, the axle-retaining member adapted to support an axle and provide for unabated rotation of an axle, a second axle disposed through the second axle-retaining member, a second spindle integral with the second axle, a braking means intergral with the second reel support, the braking means comprising, a disk immovably secured to the axle supported by the second axle-retaining member, a caliper means fitted to the second reel support, the caliper means being operative to receive the disk, the caliper means having a means for selectively imparting a braking force on the disk.

6. The apparatus of claim 5, which includes means integral with the second axle for selectively imparting a torque to the reel opposite the direction of reel rotation.

7. The apparatus of claim 5, wherein the first and second spindles may be provided with a plurality of splines.

* * * * *